US009566636B2

(12) United States Patent
Del Fabro

(10) Patent No.: US 9,566,636 B2
(45) Date of Patent: Feb. 14, 2017

(54) APPARATUS FOR BENDING ELONGATED METAL ELEMENTS, SUCH AS METAL BARS, ROUND PIECES OR WIRE, AND RELATIVE BENDING METHOD

(75) Inventor: Giorgio Del Fabro, Udine (IT)

(73) Assignee: M.E.P. MACCHINE ELETTRONICHE PIEGATRICI SPA, Reana Del Rojale (IT)

( * ) Notice: Subject to any disclaimer, the term of this patent is extended or adjusted under 35 U.S.C. 154(b) by 1302 days.

(21) Appl. No.: 13/511,572

(22) PCT Filed: Nov. 23, 2010

(86) PCT No.: PCT/EP2010/068056

§ 371 (c)(1),
(2), (4) Date: Jul. 30, 2012

(87) PCT Pub. No.: WO2011/064222

PCT Pub. Date: Jun. 3, 2011

(65) Prior Publication Data

US 2012/0279274 A1 Nov. 8, 2012

(30) Foreign Application Priority Data

Nov. 24, 2009 (IT) ..... UD2009A0215

(51) Int. Cl.
*B21F 1/00* (2006.01)
*B21D 11/12* (2006.01)

(52) U.S. Cl.
CPC *B21F 1/00* (2013.01); *B21D 11/12* (2013.01)

(58) Field of Classification Search
CPC ..... B21D 11/12; B21D 7/02; B21D 7/024; B21D 7/025; B21D 7/04; B21D 11/06;B21D 7/022; B21F 1/004; B21F 1/006; B21F 1/008; B21F 1/00
See application file for complete search history.

(56) References Cited

U.S. PATENT DOCUMENTS 1,836,502 A 12/1931 Poole
2,153,935 A * 4/1939 Neukirch ..... B21D 7/022 72/217

(Continued)

FOREIGN PATENT DOCUMENTS

DE 3416678 A1 1/1985
GR WO 03082492 A1 * 10/2003 ..... B21D 11/12

OTHER PUBLICATIONS

International Search Report & Written Opinion for PCT/EP2010/068056 mailed Mar. 24, 2011.

*Primary Examiner* — Moshe Wilensky
*Assistant Examiner* — Pradeep C Battula
(74) *Attorney, Agent, or Firm* — Flaster/Greenberg P.C.

(57) ABSTRACT

The present invention relates to an apparatus and method for bending elongated metal elements. The apparatus includes a bending station provided with a first contrasting pin, a bending support defining a first bending plane on which the elongated metal elements are positioned and advance, and a first bending pin mounted mobile around the first contrasting pin, in order to bend the elongated metal elements on the first bending plane in cooperation with the first contrasting pin. The bending station further includes a second contrasting pin mounted on the first bending pin, and a second bending pin disposed mobile with respect to a bending support in a slanting direction with respect to the first bending plane, in order to bend the elongated metal elements in cooperation with the second contrasting pin on a second bending plane, angled with respect to the first bending plane.

12 Claims, 2 Drawing Sheets

(56) References Cited

U.S. PATENT DOCUMENTS

| | | | | | |
|---|---|---|---|---|---|
| 4,485,658 | A * | 12/1984 | Stewart | B21D 7/024 | 72/149 |
| 4,625,531 | A * | 12/1986 | Lafrasse | B21D 7/024 | 72/150 |
| 4,993,253 | A * | 2/1991 | Del Fabro | B21D 7/12 | 72/217 |
| 5,088,310 | A * | 2/1992 | Anagnostopoulu | B21D 7/12 | 72/217 |
| 5,193,378 | A * | 3/1993 | Ritter | B21D 7/12 | 72/21.3 |
| 5,425,257 | A * | 6/1995 | Kitsukawa | B21D 7/08 | 72/12.3 |
| 6,434,995 | B1 * | 8/2002 | Kataoka | B21D 7/024 | 72/149 |
| 6,813,922 | B2 * | 11/2004 | Etienne | B21D 11/12 | 72/217 |
| 2007/0256466 | A1 * | 11/2007 | Anagnostopoulos | B21D 11/12 | 72/294 |

* cited by examiner

APPARATUS FOR BENDING ELONGATED METAL ELEMENTS, SUCH AS METAL BARS, ROUND PIECES OR WIRE, AND RELATIVE BENDING METHOD

BACKGROUND OF THE INVENTION

Field of the Invention

The present invention concerns an apparatus for bending elongated metal products, such as for example metal bars, round pieces, wire or other, both pre-cut or fed from a roll. In particular, the apparatus according to the present invention is applied to make stirrups, or other reinforcement elements for the building trade, having a three dimension conformation, that is, with at least a portion bent back on an orthogonal plane, or in any case angled, with respect to the normal bending plane of the other portions.

The present invention also concerns a method for bending elongated metal products in order to obtain stirrups with a three dimension conformation.

Description of Related Art

Bending machines are known, also by the name of stirrup-making machines, which are configured to bend a metal bar, round piece, wire or other similar metal product, in order to make stirrups for reinforcement cages.

One example of these machines is disclosed in U.S. Pat. No. 1,836,502.

Two types of reinforcement stirrup are substantially known, that is, the so-called two-dimensional stirrups and the so-called three-dimensional stirrups, both able to be disposed in succession with respect to each other and connected by longitudinal bars so as to define the reinforcement cage.

Two-dimensional stirrups are more widespread on the market and define the transverse profile of the reinforcement cage substantially on the same bending plane.

Three-dimensional stirrups have their shape defined on a first bending plane coinciding with the feed plane and at least a portion, or segment, angled with respect to the first bending plane, for example with the function of spacer, or reference element, with respect to another stirrup or another existing structure.

This type of stirrup is made by means of automatic bending machines which provide, as well as a drawing station and a shearing station, a first bending station which makes the bends on the first bending plane, in order to define the two-dimensional shaping of the stirrup, and a distinct and subsequent second bending station which makes the bends in order to define the portions or segments angled with respect to the first bending plane.

In general, the first bending station essentially consists of at least a bending support, or mandrel, generally in the shape of a disc, rotating around a normally central axis, defining the first bending plane and provided centrally with a contrasting pin. On one spoke of the mandrel a bending element is provided, substantially coplanar to the contrasting pin.

The bending element can be rotated both in a clockwise direction and in an anti-clockwise direction, around the contrasting pin, so that the elongated metal object is shaped by plastic deformation around the contrasting pin, in one direction or the other.

In the same way, the second bending station, normally distanced and autonomous with respect to the first bending station, provides a contrasting member disposed at a distance from the feed plane of the bar, in order to allow the elongated metal element to be bent to be positioned between it and the feed plane, and a movable bending element exiting from the feed plane in order to intercept a segment of the elongated metal element, so that the elongated metal element is shaped by plastic deformation around the contrasting member.

This type of known bending machine, providing two distinct bending stations, needs a double line of command and control, both mechanical and electronic, in order to guarantee the management and operating coordination of the two bending stations.

This management need entails an increase in production times and costs of the apparatus, as well as maintenance times and costs.

Moreover, by providing two distinct stations, the number of mechanical components which participate in the individual movements is also high, and the apparatus is bulkier than traditional machines, with consequent increases in installation bulk, and the bending precision can also be compromised.

BRIEF SUMMARY OF THE INVENTION

One purpose of the present invention is to make a bending apparatus which allows to make both two-dimensional stirrups and three-dimensional stirrups, which has limited times and costs both for production, management and coordination, and which provides simplified maintenance steps.

A further aim of the present invention is to make a bending apparatus which allows to make both two-dimensional stirrups and three-dimensional stirrups, which has reduced installation bulk compared to similar known bending machines and which guarantees optimal bending precision.

Another purpose of the present invention is to perfect a bending method for elongated metal objects which allows to remedy the disadvantages of the state of the art.

The Applicant has devised, tested and embodied the present invention to overcome the shortcomings of the state of the art and to obtain these and other purposes and advantages.

The present invention is set forth and characterized in the independent claims, while the dependent claims describe other characteristics of the invention or variants to the main inventive idea.

In accordance with the above purposes, a bending apparatus and method according to the present invention are applied to bend elongated metal objects, so as to obtain bent elements, which can be used for example as reinforcements in the building trade, having a three dimension conformation.

In particular, the bending apparatus according to the present invention comprises a bending station provided with first contrasting means, a bending support defining a first bending plane on which the elongated metal elements are able to be positioned and to advance, and first bending means mounted mobile around the relative first contrasting means, in order to bend the elongated metal elements on the first bending plane in cooperation with the first contrasting means.

According to a characteristic feature of the present invention, the bending station itself comprises second contrasting means mounted on the first bending means, and second bending means disposed mobile with respect to the bending support in a slanting direction with respect to the bending plane, in order to bend the elongated metal elements in cooperation with the second contrasting means, on a second bending plane, angled with respect to the first bending plane.

With the present invention, with only one bending station the elongated metal elements can be bent both on the first plane and also on the second plane, defining a bent element, for example a reinforcement stirrup, the portions of which lie on different planes, angled with respect to each other.

In this way, in order to obtain a bent element on three dimensions only one bending station is used, and it is therefore possible to provide only one command and control line, both mechanical and electronic, in order to guarantee the correct and desired operating coordination.

This advantage allows to contain both the production times and costs of the machine, as well as the maintenance times and costs.

Moreover, by providing only one station with two bending means integrated, each suitable to bend on a different plane, the result is that the mechanical components which make up the station are also reduced, compared with the two distinct stations in the state of the art.

This advantage allows to reduce the overall installation bulk of the apparatus.

According to a variant, the bending support can be selectively positioned between a first bending position, substantially coplanar and/or raised with respect to the first bending plane, and a second lowered inactive position, completely below the first bending plane.

According to another variant, each contrasting mean comprises at least a relative contrasting pin having a determinate diameter, depending on the bending radius desired.

The bending method according to the present invention provides a first bending step, in which by means of the first bending means the elongated metal elements are bent on the first bending plane, in cooperation with the first contrasting means; and a second bending step in which, by means of the second bending means, the elongated metal elements are bent in cooperation with the second contrasting means mounted on the first bending means, on a second bending plane angled with respect to the first bending plane.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

Figure 1:
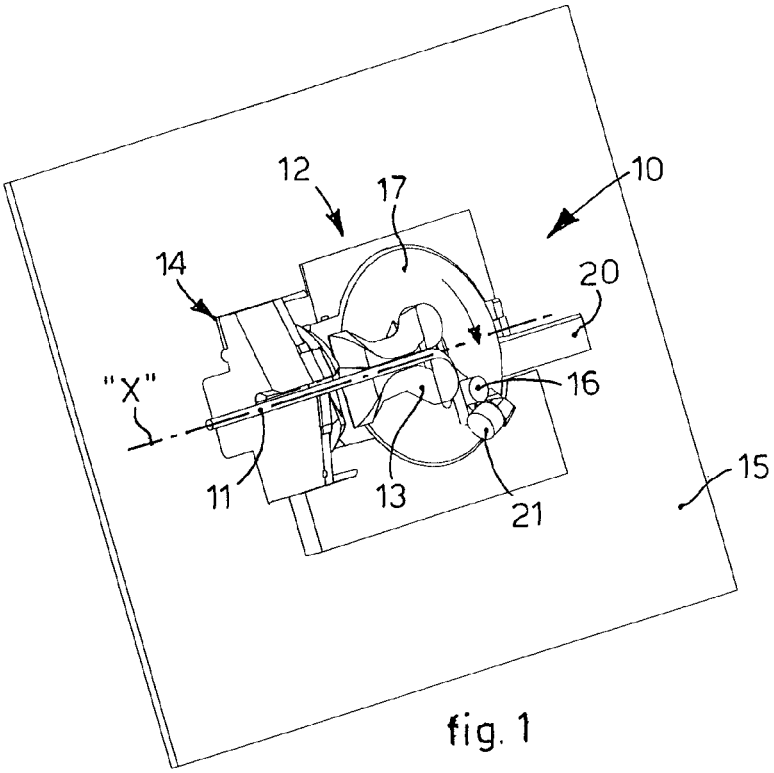
FIG. 1 shows schematically a detail of the bending apparatus according to the present invention in a first operating condition.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF THE INVENTION

Figure 2:
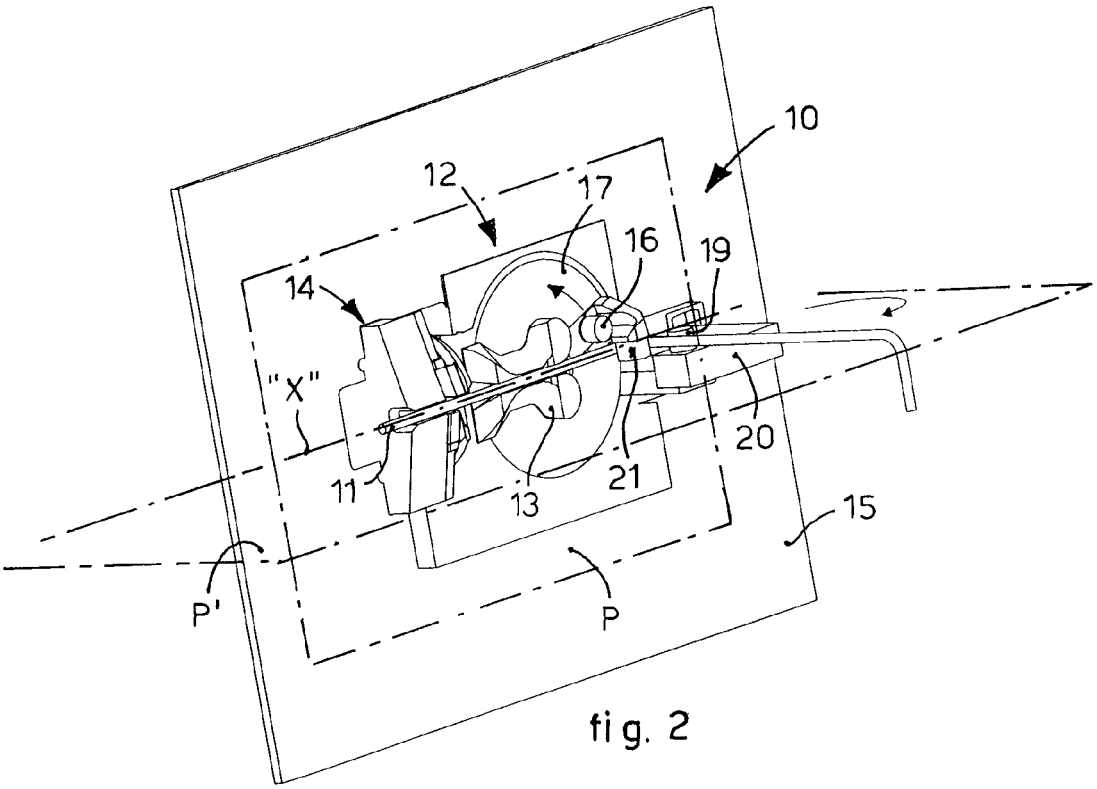
FIG. 2 shows schematically a detail of the apparatus in FIG. 1 in a second operating position.

With reference to the attached drawings, a bending apparatus 10 according to the present invention is applied to a bending machine 15, of the substantially known type and shown in FIGS. 1 and 2 only in a representative way from one of its portions.

The bending apparatus 10 is of the type able to bend one or more metal bars 11, for example of the type used to make stirrups or other reinforcement shapes for the building trade.

In particular, the bending apparatus 10 is conformed so as to bend the metal bars 11 both with respect to a first plane P and also with respect to a second plane P', in this case, substantially orthogonal to the first plane P.

The metal bar 11 is fed along an axis of feed "X" by a feed unit, of a known type and indicated generically by the reference number 14, disposed upstream of the bending apparatus 10.

The bending apparatus 10 according to the present invention comprises a bending station 12 provided with a first contrasting pin 13, a mandrel 17 or bending support, mounted coaxial and rotatable with respect to the first contrasting pin 13, and able to define the first plane P, and with a first bending pin 16 mounted peripherally to the mandrel 17.

In this way, each first bending pin 16 can be selectively rotated in a clockwise or anti-clockwise direction, around the relative first contrasting pin 13, so as to effect the desired bending of the bar 11, in one direction or the other, in cooperation with the first contrasting pin 13.

First double contrasting pins 13 have been schematically shown in the attached drawings, but this does not exclude that in different operating solutions, first contrasting pins 13, of a substantially cylindrical shape, shaped and of other forms and dimensions can be provided.

Advantageously the bending station 12 is selectively movable in a direction orthogonal to the first plane P In this way it is possible to selectively define a first raised operating position, in which the mandrel 17 is coplanar to the first plane P and the first pins 13 and 16 are disposed above the first plane P, and a second lowered inactive position, in which both the mandrel 17 and also the two pins 13 and 16 are completely below the first plane P.

The bending apparatus 10 also comprises a second bending pin 19 mounted on a mobile structure 20, and a second contrasting pin 21 mounted on the first bending pin 16.

As shown in the operating sequence in FIGS. 1 and 2, the mobile structure 20 is selectively movable between a first inactive position, where it is below the first plane P and the second bending pin 19 does not interfere with the axis of feed X of the metal bar 11, and a second bending position in which it protrudes from the plane P and the second bending pin 19 interferes with the axis of feed X of the metal bar 11, bending the latter on the second plane P'.

Figure 4:
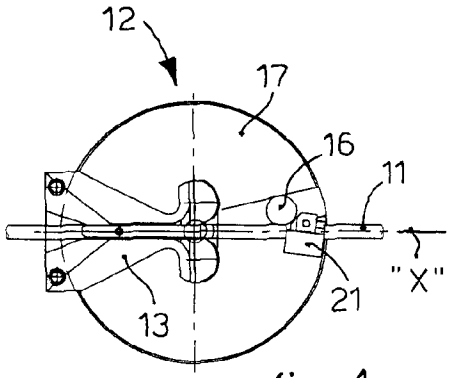
FIG. 4 shows a plane view of an enlarged detail of the apparatus in FIG. 1.

In particular, as shown in FIG. 4, the assembly of the second contrasting pin 21 with respect to the first bending pin 16 is such that, during the bending steps on the first plane P, the first bending pin 16 always contacts the metal bar 11 first, during the bending, both from the right side and also from the left side, with respect to the axis of feed X.

This conformation allows the most ample operating freedom to bend on the first bending plane P.

Moreover, the second contrasting pin 21 remains, in any case, above the metal bar 11, holding the metal bar 11 in an adherent condition to the first bending plane P during the bending steps with the first bending pin 16.

This operating condition is even more advantageous in the case of bending two metal bars 11 at the same time, so as to prevent the metal bars 11, especially the one nearest the first plane P, from rotating and from twisting upward, because of the forces in play during the bending.

Figure 3:
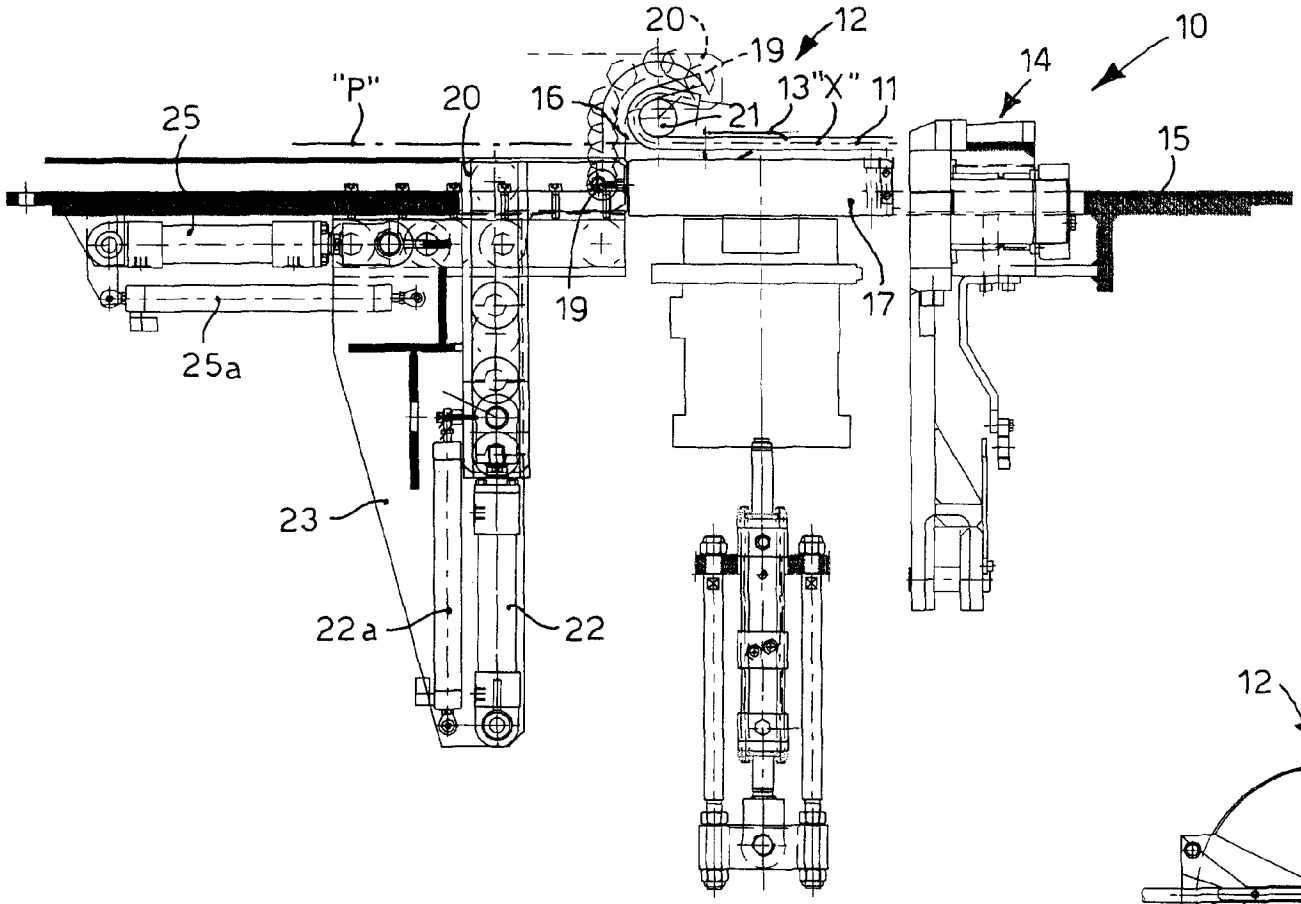
FIG. 3 shows a view in section of the apparatus in FIG. 1.

In this case, with particular reference to FIG. 3, the bending apparatus 10 according to the invention comprises a first linear actuator 22, constrained on one side on a movement slider 23 and on the other side to the support structure 20.

The first linear actuator 22 is suitable to command the movement of the support structure 20 along a first direction of movement, for example in order to move the support structure 20 between the first inactive position and the second bending position.

The bending apparatus 10 also comprises a second linear actuator 25 disposed in a fixed position to move the movement slider 23 in a second direction of movement, substantially orthogonal to the first direction of movement commanded by the first linear actuator 22.

In this way, the support structure 20, and consequently the relative second bending pin 19, can determine both a bending of the metal bar 11 at an angle of about 90° with respect to the axis of feed X on the second plane P', and also a bending up to about 180° with respect to the axis of feed X on the second plane P'.

This because the movement commanded by the first linear actuator 22 is combined with the movement commanded by the second linear actuator 25, so that the second bending pin 19 follows a substantially curvilinear trajectory around the second contrasting pin 21, as shown by the line of dashes in FIG. 3, defining the bending radius of the metal bar 11.

Advantageously, each linear actuator 22 and 25 is operatively controlled by a corresponding linear transducer 22*a* and 25*a*, so as to execute in a programmed or programmable manner the combination of movements, for example by means of a command and control unit, not shown in the drawings.

It is clear that modifications and/or additions of parts or steps may be made to the apparatus 10 and the method as described heretofore, without departing from the field and scope of the present invention.

It falls within the scope of the present invention, for example, to provide that the support structure 20 is mounted sliding along curvilinear guides, so as to have a corresponding curvilinear movement in its passage between the first inactive position and the second bending position.

In this case, the curvilinear movement of the second bending pin 19 is determined by the curvilinear conformation of the curvilinear guides functional to the movement of the bending support 20.

It is also clear that, although the present invention has been described with reference to some specific examples, a person of skill in the art shall certainly be able to achieve many other equivalent forms of apparatus for bending elongated metal products, such as metal bars, round pieces or wires, and relative bending method, having the characteristics as set forth in the claims and hence all coming within the field of protection defined thereby.

I claim:

1. An apparatus for bending elongated metal elements comprising a bending station provided with a first contrasting pin, a mandrel defining a first bending plane on which said elongated metal elements are able to be positioned and advance, and a first bending pin mounted mobile around the first contrasting pin, in order to bend said elongated metal elements on said first bending plane in cooperation with said first contrasting pin, wherein the bending station comprises a second contrasting pin mounted on said first bending pin, and a second bending pin mounted mobile with respect to said mandrel in a slanting direction with respect to said first bending plane, in order to bend said elongated metal elements in cooperation with said second contrasting pin on a second bending plane, angled with respect to said first bending plane.

2. The apparatus as in claim 1, wherein said second bending pin is mounted on a support structure mobile between a first inactive position, in which the support structure is below the first bending plane, keeping the second bending pin in a condition of non-interference with an axis of feed of the elongated metal elements, and a second bending position, in which the support structure protrudes from said first bending plane and takes said second bending pin into a condition of interference with said axis of feed, in order to bend said elongated metal element on the second bending plane.

3. The apparatus as in claim 2, further comprising a first linear actuator, constrained on one side by a movement slider and on another side by the support structure, in order to move the support structure in a first direction of movement.

4. The apparatus as in claim 3, further comprising a second linear actuator disposed in a fixed position to move the movement slider in a second direction of movement substantially orthogonal to the first direction of movement commanded by the first linear actuator.

5. The apparatus as in claim 4, wherein each of the first and second linear actuators are operatively controlled by a corresponding linear transducer, so as to command a combination of the movements actuated by each of the first and second linear actuators, and to define a desired trajectory of movement of the support structure.

6. The apparatus as in claim 2, wherein the mandrel can be selectively positioned between a first bending position, substantially coplanar and/or raised with respect to the first bending plane, and a second lowered inactive position, completely below the first bending plane.

7. The apparatus as in claim 2, wherein each of the first and second contrasting pins has a determinate diameter, able to define a bending radius for said elongated metal element.

8. The apparatus as in claim 1, wherein the mandrel can be selectively positioned between a first bending position, substantially coplanar and/or raised with respect to the first bending plane, and a second lowered inactive position, completely below the first bending plane.

9. The apparatus as in claim 8, wherein each of the first and second contrasting pins has a determinate diameter, able to define a bending radius for said elongated metal element.

10. The apparatus as in claim 8, further comprising a first linear actuator, constrained on one side on a movement slider and on another side to the support structure, in order to move the support structure in a first direction of movement.

11. The apparatus as in claim 1 wherein each of the first and second contrasting pins has a determinate diameter, able to define a bending radius for said elongated metal element.

12. The apparatus as in claim 11, further comprising a first linear actuator, constrained on one side on a movement slider and on another side to the support structure, in order to move the support structure in a first direction of movement.

* * * * *